United States Patent [19]

Pfister

[11] 4,183,471

[45] Jan. 15, 1980

[54] ALFALFA SEPARATOR

[76] Inventor: George Pfister, P.O. Box 597, Lexington, Nebr. 68850

[21] Appl. No.: 880,189

[22] Filed: Apr. 24, 1978

[51] Int. Cl.[2] ..... B02C 23/08; B02C 13/288

[52] U.S. Cl. ..... 241/57; 241/59; 241/73; 241/186 R

[58] Field of Search ..... 241/73, 53, 49, 54, 241/57, 58, 59, 69, 186.2, 186 R

[56] References Cited

U.S. PATENT DOCUMENTS

| | | | |
|---|---|---|---|
| 2,225,781 | 12/1940 | Hinerfeld | 241/73 |
| 2,233,728 | 3/1941 | Bell | 241/59 |
| 3,540,665 | 11/1970 | Snoek | 241/73 |
| 3,627,211 | 12/1971 | Leach | 241/73 X |
| 3,661,159 | 5/1972 | Pietrucci | 241/53 |
| 3,899,139 | 8/1975 | Okada et al. | 241/73 X |

*Primary Examiner*—Richard B. Lazarus
*Attorney, Agent, or Firm*—Larson, Taylor and Hinds

[57] ABSTRACT

An alfalfa separator is provided for separating the coarser stem and fiber portion of the alfalfa plant from the finer leaf portion. The separator includes a housing having a chamber therein. The bottom part of the chamber is defined by a screen which is sized to pass the finer portions of the alfalfa. A drum having a plurality of hammers located about the periphery of the drum is mounted for rotation within the chamber. The drum serves, by means of the hammers and the centrifugal forces generated during rotation, to grind up the alfalfa so that the finer portions pass through the screen. A passageway, located above the screen and including an inlet aperture in communication with the chamber, is disposed so that the coarser portions can pass out from the chamber under the influence of the forces referred to above. A gate controls opening and closing of the passage, and suction is used in drawing off and removing the coarser portions.

7 Claims, 2 Drawing Figures

ALFALFA SEPARATOR

FIELD OF THE INVENTION

The present invention relates to an alfalfa separator apparatus for separating the coarse and fine portions of the alfalfa plant.

BACKGROUND OF THE INVENTION

It is desirable for many feeding operations to separate the fibrous portions of a chopped alfalfa plant, i.e., the stem material, from the remaining powdered portion of the plant, i.e., the leaves, because the latter is, relatively speaking, very high in protein while the former is essentially a bulk material with lesser protein and other nutrient value. Although attempts have been made to separate these parts by shaking the fine materials through a screen, it has been the experience of the inventor that no one has accomplished the separation in a manner which is practical and economically feasible.

Two examples of prior art devices used in cutting alfalfa and similar feed materials are disclosed in U.S. Pat. Nos. 943,308 (Jorgensen) and 1,306,500 (Rankin). The Jorgensen patent discloses an alfalfa cutter wherein outer blades rotate and everything is passed through a screen. The Rankin patent discloses a feed material grinder including a series of vertical blades and a screen located therebelow. The devices shown in these two patents are fairly typical of the state of the art.

Separators for other materials are also known. Examples of such separators include those disclosed in U.S. Pat. Nos. 2,267,326 (Eissmann); 2,552,565 (Les Veaux); 2,592,994 (Ahlmann); 3,542,037 (Pietralunga); 3,661,159 (Pietrucci) and 3,899,139 (Okada). Briefly considering these patents, the Eissmann patent discloses an air separator for comminuted tobacco wherein suction is used to draw off the leaf portion from a falling leaf-stem mass. The Les Veaux patent discloses an air swept rotary beater and separator wherein dust is captured in a vortex in the middle of the device and drawn away, with coarse materials being drawn to the outside. The Ahlmann patent similarly discloses a centrifugal grinder providing circulation of the mass and suction removal of the ground material. The Pietralunga patent discloses a cut tobacco stemmer device of the ballistic and pneumatic type, the device providing separation of the light leaf and heavy stem. The Pietrucci patent discloses an apparatus for stemming tobacco leaves and separating the products obtained including a rotary chamber which provides for grinding of the mass sufficiently to permit the light material to be drawn off pneumatically. The Okada patent discloses a crushing apparatus for tires wherein the non-crushable portions are floated by air currents for separation purposes.

SUMMARY OF THE INVENTION

In accordance with the invention, an alfalfa separator apparatus is produced which provides rapid and efficient separation of the leaf or fine portion from the stem or fiber portion. The separator apparatus of the invention is readily incorporated in existing grinder-separators and is economical to build and operate.

According to a preferred embodiment thereof, the alfalfa separator apparatus of the invention comprises a housing including an intake for receiving alfalfa fed to the apparatus; means defining a chamber within the housing and including a lowermost screen portion having holes therein of such a size as to permit fine leaf portions of the alfalfa plant to pass therethrough; and a drum mounted for rotation within the chamber and including a plurality of radially extending hammers disposed about the periphery thereof, the chamber defining means further comprising means defining a passageway, located above the screen portion and including an inlet aperture in communication with the chamber, through which coarse stem portions of the alfalfa plant can pass in response to the forces generated during rotation of the drum.

The apparatus further comprises a suction arrangement for drawing off the coarse portions of the alfalfa plants passing through the passageway. This suction arrangement includes a gate which controls opening and closing of the passageway so as to control the operation of the separator. The suction arrangement also includes a further gate or slidable cover which controls the size of an opening in an outlet passage or conduit in communication with the chamber passageway and thus controls air flow in the apparatus.

Other features and advantages of the invention will be set forth in, or apparent from, the detailed description of a preferred embodiment found hereinbelow.

DESCRIPTION OF A PREFERRED EMBODIMENT

Figure 1:
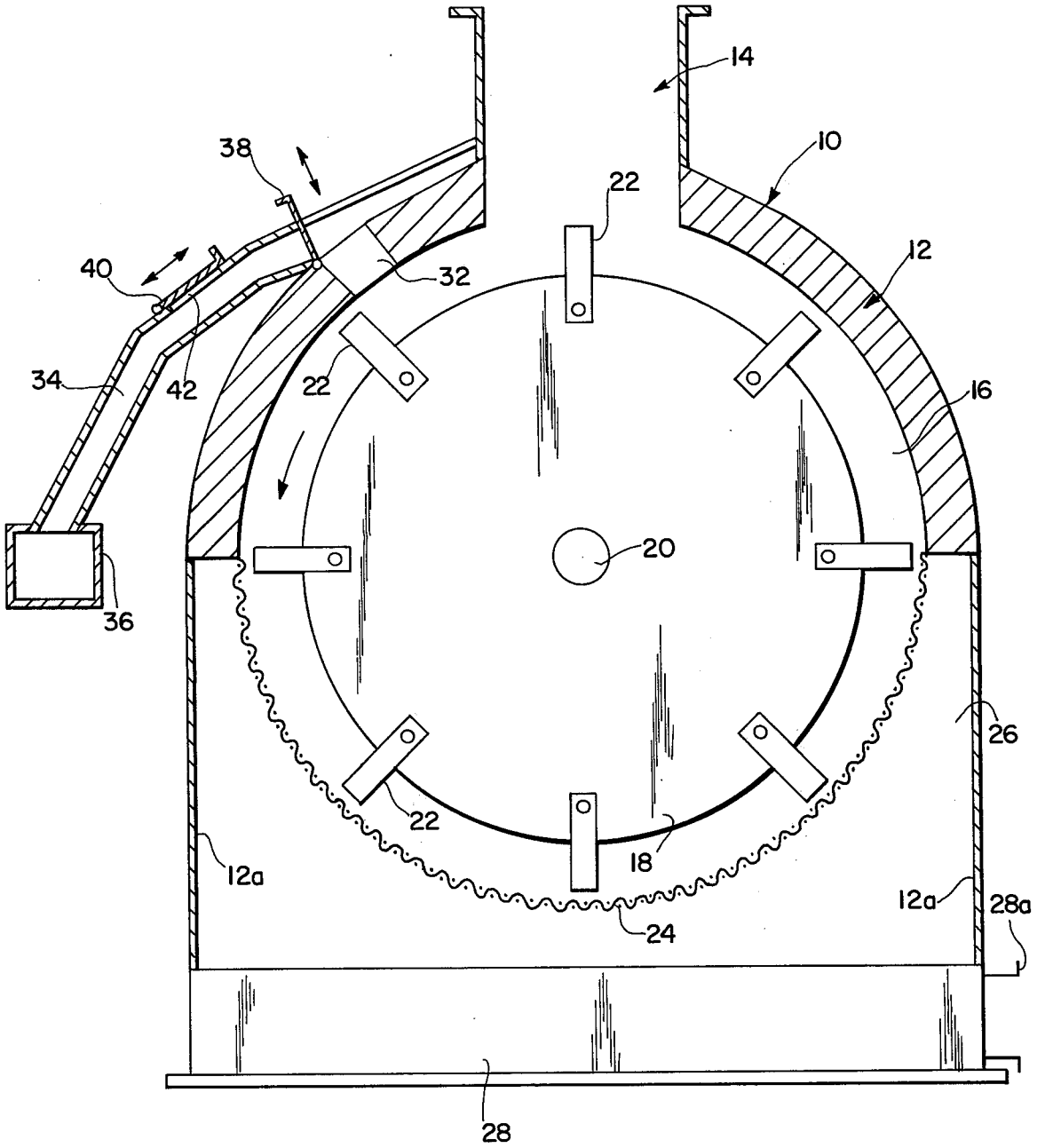
FIG. 1 is an end elevational view, partially in section, of an alfalfa separator constructed in accordance with the invention.
Figure 2:
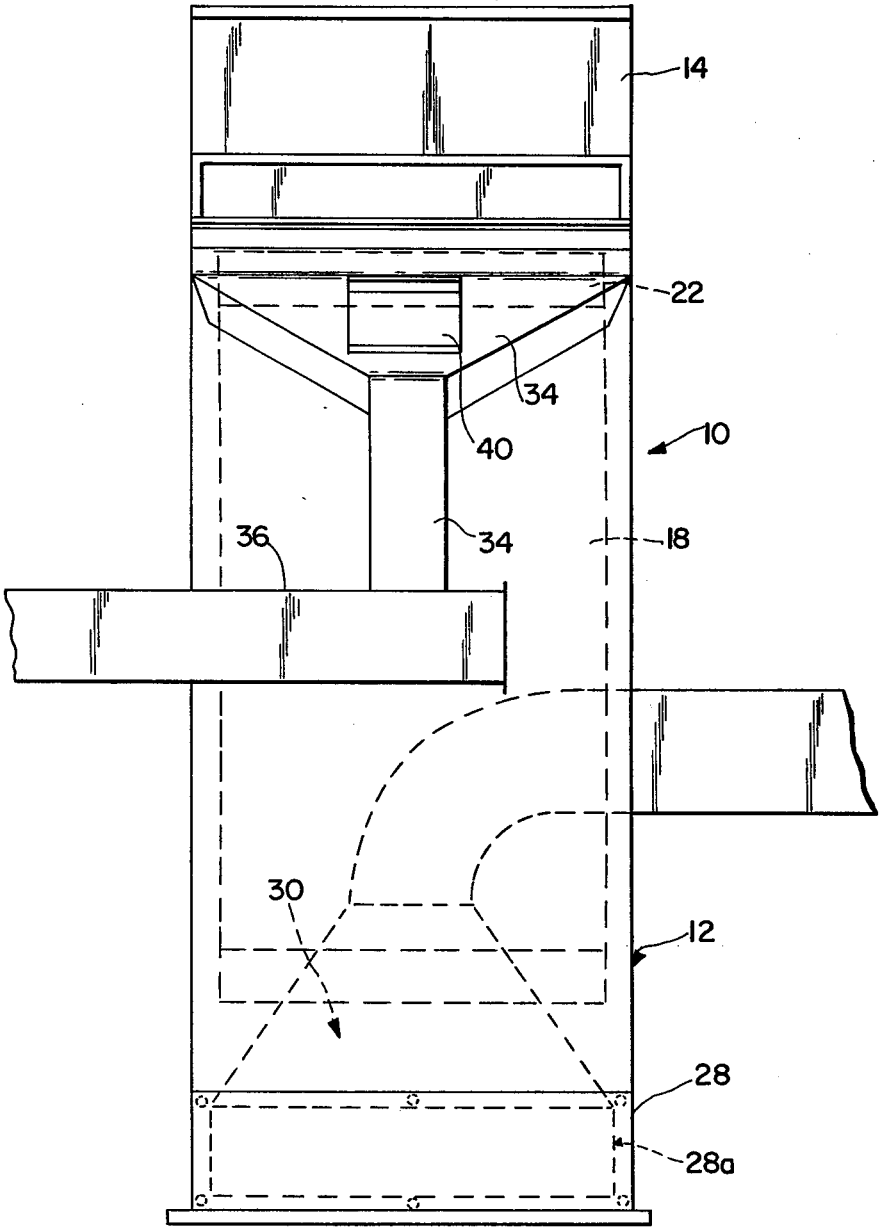
FIG. 2 is a side elevational view of the separator of FIG. 1, with a further suction removal arrangement added.

Referring to FIGS. 1 and 2, the alfalfa separator of the invention, which is generally denoted 10, includes a housing 12 provided with an input chute 14. Housing 12 includes a generally cylindrical cavity or chamber 16 in which a drum or cylinder 18 is mounted for rotation. Drum 18 is mounted on a central shaft 20 which is driven by a suitable drive means (not shown). Drum 18 includes a plurality of radially extending impacting members or hammers 22 mounted equidistantly about the periphery thereof. Hammers 22 strike and break up the alfalfa fed to chamber 16 through chute 14.

The bottom half of chamber 16 is formed by a semicircular screen 24 which is disposed in a lower portion of housing 12 as illustrated. The lower sidewalls **12*a* of housing 12 define a further chamber 26 located below screen 24 and into which fine portions of the alfalfa fall or are driven. Chamber 26 communicates directly with a bottom hopper 28 from which the fine portions are removed through an outlet 28*a*. Removal of these fine portions can be accomplished by, for example, drawing them off using a suction pump arrangement such as is shown at 30 in FIG. 2**.

The apparatus described thus far is generally conventional. As mentioned hereinabove, in such conventional apparatus, the separator actually operates as a grinder to grind and pulverize the alfalfa fed through chute 14 by means of the centrifugal forces produced by rotation of drum 18 and the action of hammers 22. In accordance with this operation, the alfalfa is pulverized to such a degree that all of it is eventually made small enough to pass through the screen.

According to the present invention, an aperture or opening 32 is provided in an upper wall of housing 12 which serves in defining chamber 16, aperture 32 providing a passage through which the fiber or stems of the alfalfa plants pass. Because of the action of the hammers 22, and the centrifugal forces generated as described above, the alfalfa fiber will be thrown against the housing wall defining chamber 16 and thus will escape through opening 32. As illustrated in FIG. 1, opening 32 is positioned so as to receive the fiber thrown off by the drum 18 and is located within a 45° sector acjacent to chute or inlet opening 14. A hollow conduit or shaft 34 communicates with opening 32 and is connected at the output end to a suction line indicated at 36. The air suction provided by suction line 36 permits removal of the fiber material. A first gate 38 is disposed in conduit 34 which, when opened, provides for drawing off of the fiber through conduit 34. To enable the suction to be readily adjusted, a second air gate 40 is utilized which selectively controls the size of an aperture 42 located in the wall of conduit 34. The setting of air gate 40 provides the desired amount of air flow through the system which, in turn, controls the percentage of fiber removed.

Thus, briefly summarizing the operation of the apparatus of the invention, the stem or fiber materials is drawn out or otherwise passed out through aperture 32 during the rotation of drum 18. While some of the pulverized leaf will also pass out through aperture 32, the vast majority will pass out through screen 24. In this regard, the openings in screen 24 are such that only fine material can pass therethrough and thus the coarse material, i.e., the fiber, can only pass out of chamber 16 through opening 32. By controlling the time of opening of gate 40, separator 10 can be operated so that a high percentage of the fine material can be drawn off through screen 24 during an initial operating period and thereafter the amount of coarse material can be removed by regulated adjusting gate 40.

Although the invention has been described relative to an exemplary embodiment thereof, it will be understood that other variations and modifications can be effected in this embodiment without departing from the scope and spirit of the invention.

I claim:

1. An alfalfa separator apparatus for separating the stem portion of the alfalfa plant from the leaf portion, said apparatus comprising:

a housing including an upper wall having a generally arcuate inner surface;

intake means located on said housing for receiving alfalfa fed to the apparatus and comprising an inlet opening located centrally of the upper wall of the housing;

means defining a chamber within said housing, said chamber defining means including the upper wall of the housing and a lowermost screen portion having holes therein of such a size as to permit fine leaf portions of the alfalfa plant to pass therethrough while preventing coarse stem portions of the alfalfa plant from passing therethrough; and a drum mounted for rotation within said chamber and including a plurality of radially extending hammers disposed about the periphery thereof;

said chamber defining means further comprising means defining a passageway, located above said screen and including a separate, discrete outlet aperture located in the upper wall of the housing in communication with said chamber, through which coarse stem portions of the alfalfa plants can pass in response to the forces generated during the rotation of said drum, said outlet aperture being located closely adjacent to said drum laterally of said inlet opening in a position so as to receive the coarse stem portions of the alfalfa plants which are thrown off from the drum by centrifugal force, said apparatus further comprising suction means for drawing off the coarse portions of the alfalfa plants passing through said passageway and means controlling the suction time of said suction means so that a high percentage of the fine material is drawn off through said screen during an initial operating period and thereafter the coarse material is removed through said passageway.

2. An alfalfa separator apparatus as claimed in claim 1 wherein said suction means includes gate means for controlling opening and closing of said passageway.

3. An alfalfa separator apparatus as claimed in claim 2 wherein said suction means further comprises an outlet passage in communication with said passageway and gate means for controlling the size of an opening located in said outlet passage so as to control the air flow in the apparatus.

4. An alfalfa separator apparatus as claimed in claim 1 wherein said suction means further comprises an outlet passage in communication with said passageway and a gate means for controlling the size of an opening located in said outlet passage so as to control the air flow in the apparatus.

5. An alfalfa separator apparatus as claimed in claim 1 further comprising further suction means for removing fine particles which pass through said screen.

6. An alfalfa separator apparatus as claimed in claim 1 wherein said outlet passageway is located within the limits of a 45% quadrant adjacent to said inlet opening.

7. An alfalfa separator apparatus as claimed in claim 1 wherein said gate means is located in a side wall defining said outlet passage and comprises an opening in said side wall and a longitudinally movable gate for selectively controlling covering and uncovering of said opening.

* * * * *